US005499957A

United States Patent [19]

Metcalf et al.

[11] Patent Number: 5,499,957

[45] Date of Patent: Mar. 19, 1996

[54] QUICK CHANGE MECHANISM FOR SYNCHRONOUS/ASYNCHRONOUS EXERCISE MACHINE

[75] Inventors: Jeffrey D. Metcalf, Albion; Daniel F. Brashear, Olney, both of Ill.

[73] Assignee: Roadmaster Corporation, Olney, Ill.

[21] Appl. No.: 288,329

[22] Filed: Aug. 10, 1994

Related U.S. Application Data

[62] Division of Ser. No. 9,717, Jan. 27, 1993, Pat. No. 5,338, 273.

[51] Int. Cl.[6] ..... A63B 69/18

[52] U.S. Cl. ..... 482/70; 482/51

[58] Field of Search ..... 482/51, 52, 53, 482/54, 70, 71; 601/27, 33, 34, 35

[56] References Cited

U.S. PATENT DOCUMENTS

| | | |
|---|---|---|
| 219,439 | 9/1879 | Blend . |
| 1,016,729 | 2/1912 | Barrett . |
| 1,766,089 | 6/1930 | Wood . |
| 1,982,843 | 12/1934 | Traver . |
| 2,274,081 | 2/1942 | Mautin . |
| 2,362,446 | 11/1944 | Bodine, Jr. . |
| 2,433,969 | 1/1948 | Wood . |
| 2,459,066 | 1/1949 | Duke . |
| 2,614,609 | 10/1952 | Denison . |
| 2,646,282 | 7/1953 | Ringman . |
| 2,772,881 | 12/1956 | Fundom . |
| 2,969,060 | 1/1961 | Swanda et al. . |
| 3,213,852 | 10/1965 | Zent . |
| 3,332,683 | 7/1967 | Rand . |
| 3,408,067 | 10/1968 | Armstrong . |
| 3,455,550 | 7/1969 | Hall . |
| 3,475,021 | 10/1969 | Ruegsegger . |
| 3,568,666 | 3/1971 | Dunn . |
| 3,572,700 | 3/1971 | Mastropaolo . |
| 3,582,069 | 6/1971 | Flick et al. . |
| 3,586,322 | 6/1971 | Kverneland . |
| 3,589,720 | 6/1971 | Agamian . |
| 3,592,466 | 7/1971 | Parsons . |
| 3,601,395 | 8/1971 | Morgan . |
| 3,650,528 | 3/1972 | Natterer . |
| 3,711,089 | 1/1973 | Reinhard . |
| 3,807,727 | 4/1974 | Ferguson . |
| 3,940,128 | 2/1976 | Ragone . |
| 3,941,377 | 3/1976 | Lie . |
| 4,023,795 | 5/1977 | Pauls . |
| 4,023,798 | 5/1977 | Pronin . |
| 4,140,185 | 2/1979 | van der Lely . |
| 4,343,466 | 8/1982 | Evans . |
| 4,385,760 | 5/1983 | Mattox et al. . |
| 4,402,506 | 9/1983 | Jones . |
| 4,434,981 | 3/1984 | Norton . |

(List continued on next page.)

FOREIGN PATENT DOCUMENTS

| | | |
|---|---|---|
| 384019 | 7/1933 | Canada . |
| 1533710 | 1/1990 | Russian Federation . |
| 416105 | 10/1934 | United Kingdom . |
| 672583 | 10/1963 | United Kingdom . |
| 2131308 | 6/1984 | United Kingdom . |

*Primary Examiner*—Stephen R. Crow
*Attorney, Agent, or Firm*—Willian Brinks Hofer Gilson & Lione

[57] ABSTRACT

A synchronous/asynchronous exercise machine is changeable between a synchronous exercise mode wherein a user's limbs, such as his legs, oppositely reciprocate, and an asynchronous exercise mode wherein the user's limbs move independently. The synchronous/asynchronous exercise machine may comprise a first movable element for accepting a user's limb, and a second movable element for accepting another limb. A load source against which the user can exercise may also be provided. A first drive belt operatively connects the first movable element to the load source, and a second drive belt operatively connects the second movable element to the load source. A quick change mechanism, which may be connected to the first movable element, is releasably engagable with the second drive belt for changing the synchronous/asynchronous exercise machine between the synchronous exercise mode and the asynchronous exercise mode.

16 Claims, 2 Drawing Sheets

U.S. PATENT DOCUMENTS 4,488,719 12/1984 Brown et al. .
4,512,571 4/1985 Hermelin .
4,519,604 5/1985 Arzounian .
4,529,194 7/1985 Haaheim .
4,540,172 9/1985 Evans .
4,550,908 11/1985 Dixon .
4,606,538 8/1986 Wang .
4,618,139 10/1986 Haaheim .
4,632,385 12/1986 Geraci .
4,645,201 2/1987 Evans .
4,653,749 3/1987 Rorabaugh .
4,659,077 4/1987 Stropkay ..... 482/70
4,684,121 8/1987 Nestegard .
4,709,918 12/1987 Grinblat .
4,714,244 12/1987 Kolomayets et al. .
4,720,093 1/1988 Del Mar .
4,728,102 3/1988 Pauls .
4,743,015 5/1988 Marshall .
4,744,558 5/1988 Smirmaul .
4,798,379 1/1989 Jenkins .
4,804,178 2/1989 Friedebach .
4,813,667 3/1989 Watterson .
4,826,152 5/1989 Lo .
4,842,265 6/1989 Kirk .
4,867,443 9/1989 Jensen .
4,900,013 2/1990 Rodgers ..... 482/70
4,938,474 7/1990 Sweeney et al. .
4,940,233 7/1990 Bull et al. .
4,948,121 8/1990 Haaheim et al. .
4,951,942 8/1990 Walden .
4,953,853 9/1990 Loane .
4,960,276 10/1990 Feuer et al. ..... 482/70
4,979,731 12/1990 Hermelin .
5,000,442 3/1991 Dalebout et al. .
5,040,785 8/1991 Charnitski .
5,064,190 11/1991 Holt .
5,090,690 2/1992 Huang .
5,108,093 4/1992 Watterson .
5,131,895 7/1992 Rodgers, Jr. .
5,203,751 4/1993 Chang .
5,230,677 7/1993 Chi .
5,246,412 9/1993 Chen .
5,277,678 1/1994 Friedebach et al. .
5,279,531 1/1994 Jen-Huey .
5,299,996 4/1994 Chi .
5,342,264 8/1994 Gordon .

QUICK CHANGE MECHANISM FOR SYNCHRONOUS/ASYNCHRONOUS EXERCISE MACHINE

This application is a division of application Ser. No. 08/009,717, filed Jan. 27, 1993, U.S. Pat. No. 5,338,273.

BACKGROUND OF THE INVENTION

The present invention relates generally to a novel construction for a synchronous/asynchronous exercise machine, such as a ski exercise machine and the like. More specifically, the invention relates to a novel quick change mechanism for changing a synchronous/asynchronous exercise machine, such as a ski exercise machine and the like, between a synchronous exercise mode and an asynchronous exercise mode.

Many people these days desire to get in shape and stay physically fit. By getting in shape and staying physically fit, people may be able to improve their health and quality of life. To provide a method by which this desire may be fulfilled, a number of firms have developed and market pieces of exercise equipment. These pieces of exercise equipment may have different constructions depending upon the type of workout provided. For instance, them am exercise cycles, rowing machines, step walkers, free weight assemblies, butterfly exercisers, and the like. Generally, each of these pieces of exercise equipment is designed to exercise a certain portion or muscle group of the human body. For example, exercise cycles may primarily exercise the leg muscles, while butterfly exercisers may primarily work on the arm muscles.

However, there are some pieces of exercise equipment which can exercise more than one muscle group at a given time. One such piece of exercise equipment is a ski exercise machine. Ski exercise machines may allow a user to exercise the leg muscles and the arm muscles, and may also provide a way for exercising the shoulder and abdominal muscles. Thus, a user working out on a ski exercise machine may be able to reduce the amount of time spent working out because a number of muscle groups can be exercised at the same time. Accordingly, ski exercise machines have become quite popular.

Ski exercise machines in general provide mechanisms for mechanically mimicking the actions and/or body movements associated with cross country skiing. In general, there are two types of machines. In one type, the ski exercise machine requires the user to reciprocate his legs in a synchronized scissor-like manner. For example, as the right leg moves forward, the left leg moves backward. Synchronization is typically provided by attaching foot supports or slides to opposite sides of a continuous loop, so that forward movement of one slide results in simultaneous rearward movement of the other slide. This regular, opposite reciprocating motion is defined, for the purposes of this disclosure, as the synchronous or novice exercise mode. This exercise mode may be recommended for a beginner starting to ski or exercise with a ski exercise machine.

In cross country skiing, however, more experienced skiers may not always oppositely reciprocate their legs, but may, at times, move their legs forward or backward independently. Thus, in a second type of ski exercise machine, the foot slides are free to move independently of each other. This independent movement is defined, for the purposes of this disclosure, as the asynchronous or expert exercise mode. Although the asynchronous mode of skiing exercise movement may be relatively difficult for a user to learn, especially for a beginner who is just learning to use a ski exercise machine, it more accurately mimics actual cross country skiing.

A few illustrative examples of machines which may be similar in some respects to the above-discussed ski exercise machines are disclosed in the following U.S. Patents.

| | | |
|---|---|---|
| Rodgers | 4,679,786 | 07/14/87 |
| Rodgers, Jr. | 4,900,013 | 02/13/90 |
| Rogers, Jr. | 5,131,895 | 07/21/92 |

While these exercise machines and apparatuses may perform well in some circumstances, and may be relatively easy for some people to use, these apparatuses do have some characteristics which may make them undesirable to some people. Specifically, the construction of these exercise apparatuses may make it difficult for a beginner to learn the proper ski exercise movements, i.e. the novice and expert exercise modes discussed above, and may also lead to an inefficient workout.

The exercise apparatuses disclosed in the above-referenced patents generally comprise a number of traveller brackets or slides for accepting forces applied by a user's legs and/or arms. Responsive to the forces applied by the exercising user, the slides travel along tracks mounted on a main frame of the exercise apparatus. In order to provide resistance to movement of the slides, a load source, against which the user can exercise, may be operatively connected to the slides, such as by a drive chain, a drive belt, or similar structure. The degree of resistance provided by the load source may be varied by appropriate methods well known to those skilled in the art. The slides may be connected to the drive chain so that as one slide moves forward, another slide moves backward. This motion may, in some circumstances, be similar to the movements associated with the above-discussed novice mode of cross country skiing. However, these exercise apparatuses may not be able to provide a user with an effective workout as the user increases his skill and strength, and may not be able to generally provide the expert exercise mode.

In order for a user to develop his body and to have an effective workout, it is desirable that each exercised limb, e.g. a leg, work against a controlled resistance. Such resistance is typically provided in one direction only, such as when pushing back with a leg, for example. This one direction is commonly referred to as a power stroke. Also, it may be desirable for the user, once he has developed sufficient skill with the movements to be performed on the exercise apparatus, to change from working out in the novice exercise mode and to begin working out in the expert exercise mode, during which the user moves each of his legs independently of each other with each leg provided with an independent power stroke.

The exercise apparatuses of the above-referenced prior art patents may not easily adapt to these changes required by the exercising user. For instance, the exercise apparatus of the '895 patent has a single drive chain to which two slides are attached. These two slides are to be driven forward and backward by the user's feet. The drive chain is, in turn, operatively connected to a brake for providing resistance to movement of the drive chain, and thus, of the slides. The single drive chain may cause the slides to relatively reciprocate similar to the novice exercise mode discussed earlier. However, as the user increases his skill, he may wish to change to the expert mode. This exercise apparatus does not allow a user to do this.

The exercise machine disclosed in the '786 patent utilizes a number of slides which may be connected to a single drive chain, or, alternatively, may be each connected to its own drive chain. The drive chain is connected to a flywheel, which provides the load, through an overrunning or one way clutch. In this manner, as the drive chain, and the connected slides, move in a predetermined driving direction, the user must work against the load provided by the flywheel to move the slides in that predetermined direction (power stroke). The clutches allow the drive chain and the slides to move freely, independent of the flywheel, in a direction opposite to the predetermined direction, and the power stroke is executed only in the predetermined direction.

The slides are connected to the drive chain by a mechanism which allows a user to change the predetermined direction of the power stroke. Therefore, at the user's option, either the forward or the rearward direction of movement of the slides may correspond to the direction of the power stroke. In this machine, the slides may also be selectively disconnected from the drive chain. Disconnection of a slide from the drive chain presents a number of drawbacks which may make that procedure, and the exercise machine in general, unattractive to a user. Specifically, by disconnecting a slide from the drive chain, the slide is also disconnected from the flywheel. The resistance against which the user needs to exercise is removed from that slide. Thus, the foot on that slide does not encounter any resistance to its movement. This can lead to an inefficient workout because the disconnected slide essentially moves freely along its associated track. Because one slide is connected to the drive chain and another is disconnected from the drive chain, the workout is unbalanced. In addition, it may be difficult to disconnect a slide from the drive chain, and further difficulties may be encountered when the user attempts to reconnect the slide to the drive chain.

The exercise apparatus disclosed in the '013 patent referenced earlier provides two slides for accepting a user's feet. Each of the slides is individually operatively connected to the flywheel by a separate drive chain. Ends of each of the drive chains, opposite to the ends thereof connected to the flywheel, are connected to a geared transmission mechanism. This transmission includes a number of gears which interact so that the slides may reciprocate in opposite directions. This may produce the motion of the novice exercise mode discussed earlier. By operating the transmission, the gears thereof can be operatively disconnected. The drive chains can then move independently, thereby possibly providing the motions of the expert exercise mode. While the transmission may allow a user to perform both the novice exercise mode and the expert exercise mode on the same exercise apparatus, the transmission mechanism is complexly constructed and expensive. A shifting mechanism of sorts must be provided for operating the transmission and thereby changing the exercise apparatus from the novice exercise mode to the expert exercise mode, and back again. The gears of the transmission may fail or become stripped if not properly positioned. The transmission comprises additional parts of the exercise apparatus which may break or wear out over time. Also, the construction of the shifting mechanism may make it difficult to change between the modes of exercise, and thus, changing between the exercise modes may take considerable time. These disadvantages, among others, may make the exercise machines and apparatuses of the above-referenced patents undesirable to some people.

Accordingly, it is desirable to provide an exercise machine, such as a ski exercise machine and the like, which is not subject to the above-discussed drawbacks. The present invention is intended to provide such an exercise machine.

SUMMARY OF THE INVENTION

A general object of an embodiment of the present invention is to provide a novel construction for an exercise machine.

A more specific object of an embodiment of the invention is to provide a novel quick change mechanism for a synchronous/asynchronous exercise machine.

Another object of an embodiment of the present invention is to provide a novel quick change mechanism for changing an exercise machine between a synchronous exercise mode and an asynchronous exercise mode which is relatively simple and inexpensive.

A synchronous/asynchronous exercise machine, constructed according to the teachings of the present invention, is changeable between a synchronous exercise mode wherein a user's limbs, such as his legs, oppositely reciprocate, and an asynchronous exercise mode wherein the user's limbs move independently. The synchronous/asynchronous exercise machine may comprise a first movable element for accepting a user's limb, and a second movable element for accepting another limb. A load source against which the user can exercise may also be provided. A first drive belt operatively connects the first movable element to the load source, and a second drive belt operatively connects the second movable element to the load source. A quick change mechanism, which may be connected to the first movable element, is releasably engagable with the second drive belt for changing the synchronous/asynchronous exercise machine between the synchronous exercise mode and the asynchronous exercise mode.

BRIEF DESCRIPTION OF THE DRAWINGS

The organization and manner of the structure and operation of the invention, together with further advantages thereof, may best be understood by reference to the following description taken in connection with the accompanying drawings, wherein like reference numerals identify like elements in which.

DETAILED DESCRIPTION OF THE ILLUSTRATED EMBODIMENT

Figure 1:
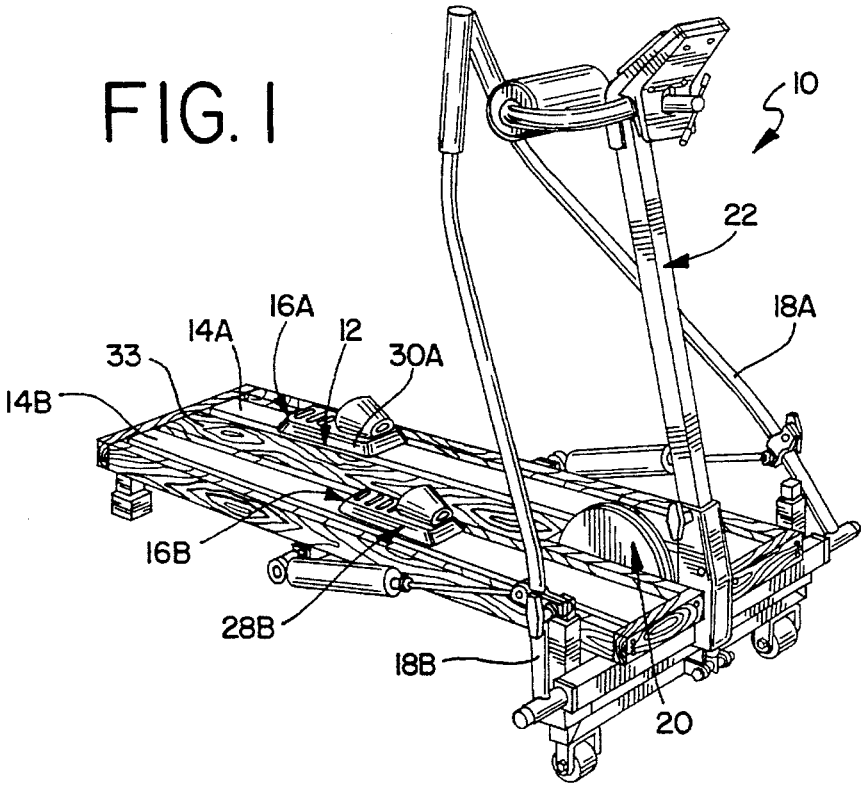
FIG. 1 is a perspective view of a synchronous/asynchronous ski exercise machine having a novel quick change mechanism constructed according to the teachings of the present invention.

While the invention may be susceptible to embodiment in different forms, there are shown in the drawings, and herein will be described in detail, specific embodiments with the understanding that the present disclosure is to be considered an exemplification of the principles of the invention, and is not intended to limit the invention to that as illustrated and described herein.

Referring initially to FIG. 1, a synchronous/asynchronous exercise machine is illustrated in the form of a ski exercise machine 10. The ski exercise machine 10 has a novel quick change mechanism 12, constructed according to the teachings of the present invention, for changing the exercise machine 10 between a synchronous exercise mode and an asynchronous exercise mode. It is to be understood that, while an embodiment of the present invention is shown in the Figures and will be described herein with reference to a ski exercise machine 10 for the sake of clarity, the scope of the present invention is not to be limited to a ski exercise machine. Thus, while the synchronous and asynchronous exercise modes, and the quick change mechanism 12 are discussed herein, for the sake of clarity, with respect to movements of a user's feet, it is to be appreciated that the teachings of the present invention apply equally to movements of other limbs, such as a user's arms. The synchronous exercise mode is generally defined as oppositely reciprocating a user's limbs, and the asynchronous exercise mode is generally defined as independently moving a user's limbs. Alternatively, the synchronous exercise mode can be generally defined as elements of a piece of exercise equipment, which accept force from a user's limbs, oppositely reciprocating, and the asynchronous exercise mode can be generally defined as the elements moving independently. It is envisioned that the teachings of the present invention may be utilized with other types or pieces of exercise equipment without departing from the scope of the invention. Accordingly, the general construction of the ski exercise machine 10 will be discussed herein only in sufficient detail to provide the reader with an appreciation of the invention.

The general construction and operation of the ski exercise machine 10 is well known to those skilled in the art. The ski exercise machine 10 shown in FIG. 1 generally comprises at least two mils 14A and 14B, two movable elements or foot trolleys 16A and 16B, two arm poles 18A and 18B, a load source or flywheel assembly 20, and a handlebar assembly 22. The construction of these elements of the ski exercise machine 10 are well known to those skilled in the art. The foot trolleys 16A and 16B are movably connected to the rails 14A and 14B, respectively, by rollers 24, visible in FIGS. 3, 5 and 6, so that the foot trolleys 16A and 16B can move forward and backward, or reciprocate along the mils 14A and 14B. The foot trolleys 16A and 16B are operatively connected to the flywheel assembly 20 so that the flywheel assembly 20 provides resistance to movement of the foot trolleys 16A and 16B. The connection between the foot trolleys 16A and 16B and the flywheel assembly 20 will be discussed in greater detail later. The foot trolleys 16A and 16B are connected to the flywheel assembly 20 by drive belts 32A and 32B, respectively. The drive belts 32A and 32B are located below board 33 visible in FIG. 2. As noted above, in some embodiments, the quick change mechanism 12 may be independent of the foot trolleys 16A and 16B. In those embodiments, the quick change mechanism 12 operatively releasably connects the drive belts 32A and 32B together to provide for changing the exercise mode. The arm poles 18A and 18B are grippable by a user's hands to mimic the action of ski poles. Cooperation of the foot trolleys 16A and 16B, the arm poles 18A and 18B, and the flywheel assembly 20 can substantially realistically reproduce the movements associated with cross country skiing.

Figure 3:
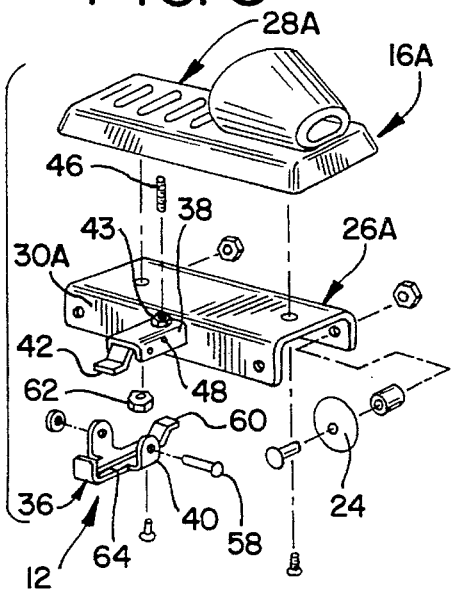
FIG. 3 is an enlarged exploded perspective view of a portion of the ski exercise machine of FIG. 2 showing the construction of the novel quick change mechanism.
Figure 4:
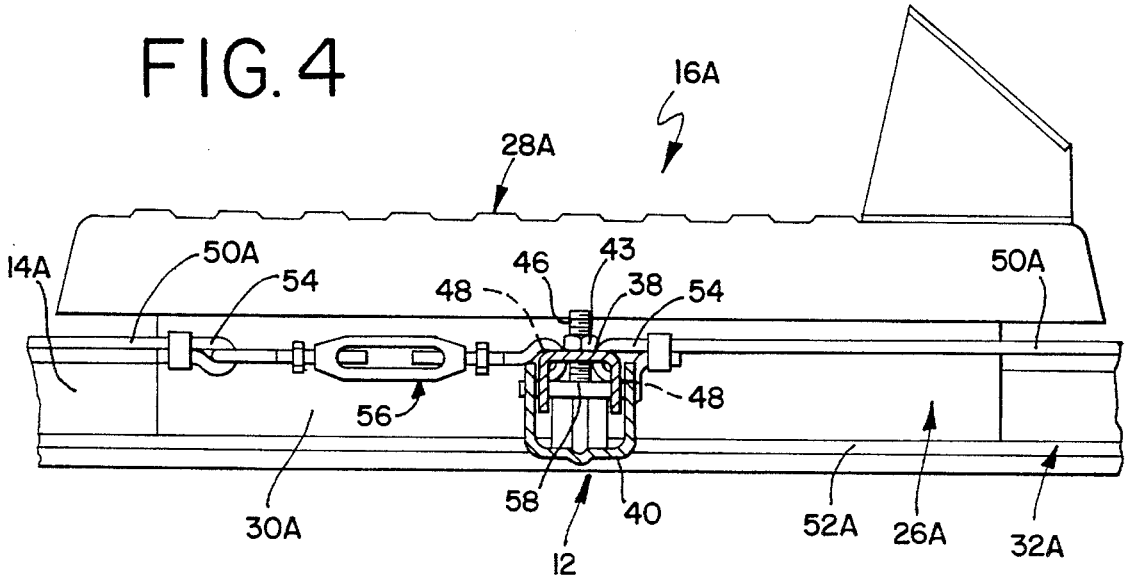
FIG. 4 is an enlarged sectional view of the quick change mechanism of FIG. 3 associated with a foot trolley and a drive belt.
Figure 5:
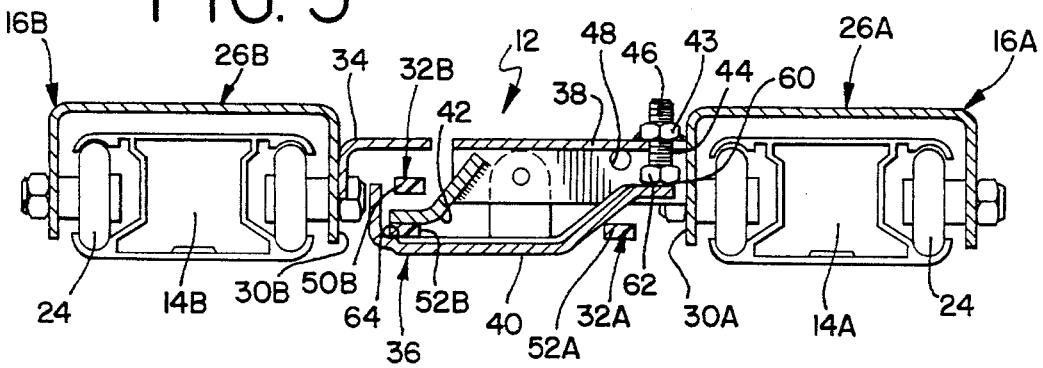
FIG. 5 is a sectional view of the quick change mechanism of FIG. 4, with portions of the associated structures removed for clarity, in a drive belt clamping position.
Figure 6:
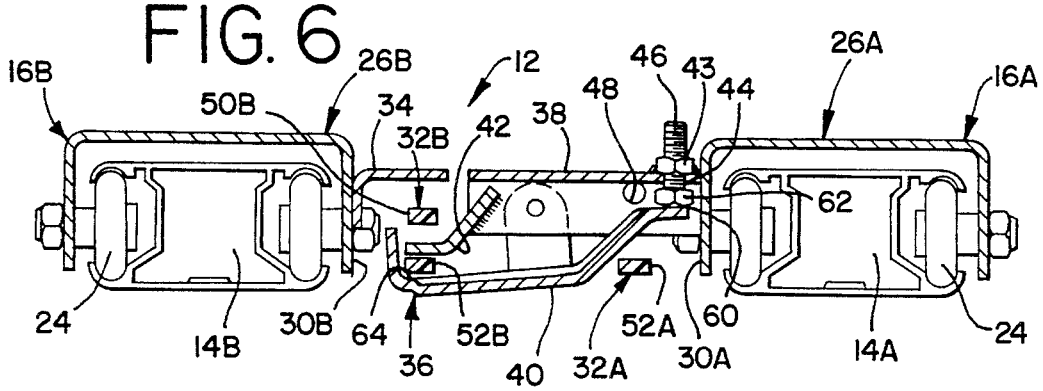
FIG. 6 is a sectional view, similar to that of FIG. 5, showing the quick change mechanism in a drive belt releasing position.

The construction of the foot trolleys 16A and 16B is shown more clearly in FIGS. 2 through 6. The foot trolleys 16A and 16B generally comprise brackets 26A and 26B which have a substantially U-shaped latitudinal cross section. The dimensions of the U-shaped cross section are sufficient so that the rails 14A and 14B can be inserted into the brackets 26A and 26B as illustrated in FIGS. 5 and 6. Foot pads 28A and 28B, respectively, are mounted on top of the brackets 28A and 26B and have a configuration constructed to facilitate force transfer from a user's foot to the foot trolleys 16A and 16B. In other embodiments of the invention, the pads 28A and 28B may be replaced with structures adapted to limbs other than the feet.

The construction of a preferred embodiment of a quick change mechanism 12 is also shown in FIGS. 2 through 6. In the illustrated embodiment, the quick change mechanism 12 extends from an inboard side 30A of the bracket 26A of the foot trolley 16A which opposes an inboard side 30B of the bracket 26B of the foot trolley 16B. It is to be understood that the quick change mechanism 12 could extend from either of the foot trolleys 16A and 16B without departing from the scope of the present invention. In other embodiments of the invention, the quick change mechanism 12 may not be attached to either foot trolley 16A or 16B, but may be an independent piece of the ski exercise machine 10.

A flange member 34 extends from the inboard side 30B of the bracket 26B of the foot trolley 16B and is used for operatively connecting the foot trolley 16B to the flywheel assembly 20. Specifically, the flange member 34 connects the drive belt 32B, a portion of which is visible in cross section in FIGS. 5 and 6, to the foot trolley 16B. The foot trolley 16A is connected to the flywheel assembly 20 by the drive belt 32A in similar fashion, shown in FIG. 4, as will be discussed below. The drive belts 32A and 32B are preferably formed from a suitable polymeric material, such as rubber and the like, and the dimensions of the flange member 34 are chosen such that the flange member 34 does not interfere with the quick change mechanism 12 or the drive belts 32A and 32B as the foot trolleys 16A and 16B are moved back and forth along the rails 14A and 14B, respectively. In a best mode embodiment of the invention, the drive belts 32A and 32B may be an HPPD belt available from Goodyear Tire and Rubber Company, or an RPP belt available from Gateshetd Pirelli. In other embodiments, the drive belts 32A and 32B may be provided in the form of chains, straps, bands and the like. Also, the drive belts 32A and 32B may have a configuration, such as a scalloped profile, for facilitating operation of the ski exercise machine 10 and the quick change mechanism 12. The flange member 34 also facilitates alignment of the foot trolleys 16A and 16B, as will also be discussed below.

The quick change mechanism 12 generally comprises a clamp element 36 for releasably engaging a portion of the drive belt 32B. By releasably engaging the drive belt 32B, the quick change mechanism 12 operatively couples the movements of the foot trolleys 16A and 16B, thereby allowing a user to change the ski exercise machine 10 between the synchronous exercise mode and the asynchronous exercise mode. This is an improvement over the above-discussed exercise apparatuses of the prior art.

The clamp element 36 includes a fixed member 38 and a movable member 40. The fixed member 38 is fixedly attached to and extends from the inboard side 30A of the foot trolley 16A. A clamping surface 42 for releasably clampingly engaging the drive belt 32B is located at an end of the fixed member 38 opposite to the end thereof connected to the bracket 26A of the foot trolley 16A. The clamping surface 42 cooperates with a portion of the movable member 38 to releasably hold the drive belt 32B. The dimensions and configurations of the clamping surface 42 and the flange member 34 are predetermined such that the flange member 34 and the clamping surface 42 do not interfere with the drive belt 32B as the foot trolleys 16A and 16B are moved along the rails 14A and 14B, respectively.

Figure 2:
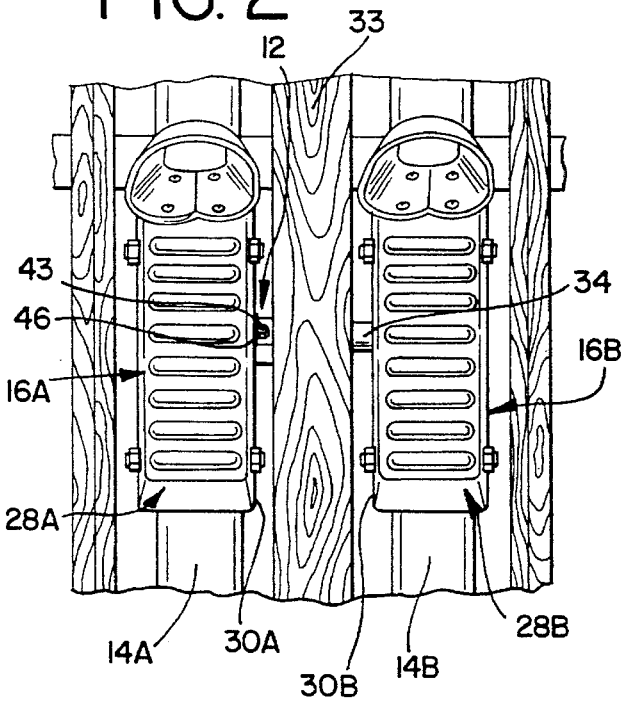
FIG. 2 is an enlarged plan view of a portion of the ski exercise machine of FIG. 1.

An aperture 44 is disposed through the fixed member 38 at a position between the inboard side 30A of the bracket 26A and the clamping surface 42. In the illustrated embodiment, the aperture 44 is located on the fixed member 38 adjacent the inboard side 30A of the bracket 26A. The aperture 44 is dimensioned for accepting a variable element or set screw 46, the significance of which will be discussed in greater detail later. The set screw 46 allows the quick change mechanism 12 to change the ski exercise machine 10 between the synchronous exercise mode and the asynchronous exercise mode. The aperture 44 is located on the fixed member 38, as shown in FIG. 2, so that the set screw 46 is easily accessible to a user. This facilitates changing of the ski exercise machine 10 between the synchronous mode and the asynchronous mode. A threaded element of nut 43 is disposed on the fixed member 38 above the aperture 44 so that the set screw 46 is treadibly movable through the aperture 44. In some embodiments, the nut 43 may be welded to or formed as an integral part of the fixed member 38.

A set of apertures 48 is disposed through the fixed member 38 between the clamping surface 42 and the aperture 44. Only one of the apertures 48 is visible in FIGS. 3 through 6. The apertures 48 are used for coupling the drive belt 32A to the foot trolley 16A. As is illustrated in FIG. 4, the drive belt 32A is deployed substantially in a loop comprising an upper course 50A and a lower course 52A. Ends of the drive belt 32A terminate in eyelets 54, and one eyelet 54 is inserted through one of the apertures 48. The other eyelet 54 is operatively connected to the other aperture 48 by means of a belt tension adjustment mechanism or turnbuckle 56. Thus, the upper course 50A of the drive belt 32A is operatively connected to the foot trolley 16A. Accordingly, as can be appreciated from the FIG. 4, as the foot trolley 16A moves to the right, as viewed, the drive belt 32A conjointly moves such that the upper course 50A moves to the right and the lower course 52A moves to the left. The drive belt 32B is connected to the foot trolley 16B through apertures in the flange member 34 in substantially the same fashion.

The movable member 40 is pivotally connected to the fixed member 38 by a journal pin 58 such that the movable member 40 is pivotal between a drive belt clamping position and a drive belt releasing position. Movement of the movable member 40 between the drive belt clamping position and the drive belt releasing position corresponds to changing the ski exercise machine 12 between the synchronous exercise mode and the asynchronous exercise mode.

An end of movable member 40 adjacent the inboard side 30A of the bracket 26A of the foot trolley 16A includes a contact surface 60 engagable with an end of the set screw 46. A lock nut 62 is disposed on the end of the set screw 46 which engages the contact surface 60. In some embodiments, the lock nut 62 may be welded to or formed integrally with the movable member 40. The lock nut 62 prevents removal of the set screw 46 from the aperture 44 in the fixed member 38, and may facilitate force transfer from the set screw 46 to the movable member 40 if the lock nut 62 engages the contact surface 60. An end of the movable member 40, opposite to the contact surface 40, includes a clamping surface 64 which cooperates with the clamping, surface 42 on the fixed member 38 to releasably clampingly engage the lower course 52B of the drive belt 32B when the set screw 46 is appropriately moved within the aperture 44 and the nut 43 against the contact surface 60.

The contact surface 60 acts as a lever arm, and the journal pin 58 acts as a fulcrum for clampingly engaging the lower course 52B of the drive belt 32B between the clamping surface 42 and the clamping surface 64. Accordingly, the lower course 52B of the drive belt 32B passes through the space between the clamping surfaces 42 and 64, while the upper course 50B of the drive belt 32B passes between an upper surface of the clamping surface 42 and a lower surface of the flange member 34. In this manner, the back and forth movement of the foot trolley 16A is operatively coupled to and thereby causes corresponding forward and backward movement of the lower course 52B of the drive belt 32B. Because the foot trolley 16B is connected to the upper course 50B of the drive belt 32B through the flange member 34, the foot trolley 16B reciprocates in directions opposite to the directions of reciprocation of the foot trolley 16A, namely as the foot trolley 16A moves forward, the foot trolley 16B moves backward, and vice versa.

The operation of the quick change mechanism 12 will now be discussed in detail. A greater appreciation of the structures and advantages of the invention may be gained by reference to the following discussion.

For the sake of illustration, the ski exercise machine 10 is in the asynchronous mode. That means that the lower course 52B of the drive belt 32B is not clamped between the clamping surfaces 42 and 64. The movable member 40 is in the drive belt releasing position shown in FIG. 6. Because there is no connection between the foot trolleys 16A and 16B, the foot trolleys 16A and 16B can be moved independently of each other. However, because each foot trolley 16A and 16B is connected to the flywheel assembly 20 through its respective drive belt 32A and 32B, each foot trolley 16A and 16B independently delivers power to the flywheel assembly 20. This is true irrespective of the exercising mode, and is a significant improvement over some of the exercise apparatuses of the prior art. To change exercise modes, the foot trolleys 16A and/or 16B do not have to be disconnected from the flywheel assembly 20. Also, the foot trolleys 16A and 16B always remain connected to the drive belts 32A and 32B. Thus, in either exercising mode, each leg of the user encounters substantially the same resistance to movement.

If the user wishes to change the ski exercise machine 10 from the asynchronous exercising mode to the synchronous exercising mode, the user laterally aligns the foot trolleys 16A and 16B as shown in FIG. 2. Specifically, the foot trolleys 16A and 16B are positioned on the rails 14A and 14B such that the fixed member 38 of the quick change mechanism 12 on the foot trolley 16A laterally aligns with the flange member 34 on the foot trolley 16B. Preferably, this lateral alignment is performed after the foot trolley 16A is positioned substantially at a lateral midline of the rail 14A. In this manner, it is insured that the foot trolleys 16A and 16B will each be able to travel back and forth along the entire length of the rails 14A and 14B.

Once the foot trolleys 16A and 16B are properly aligned, the quick change mechanism 12 is activated to change the ski exercise machine 10 from the asynchronous exercise mode to the synchronous exercise mode. The user uses a suitable tool, such as a screwdriver, an allen wrench, and the like to rotate the set screw 46 such that the lock nut 62 or the end of the set screw 46 engages the contact surface 60 on the movable member 40. As the contact surface 60 is engaged, the movable member 40 pivotally moves about the journal pin 58 from the drive belt releasing position of FIG. 6 to the drive belt clamping position of FIG. 5. The set screw 46 is advanced through the nut 43 and against the contact surface 60 a certain distance sufficient to effectively clamp the lower course 52B of the drive belt 32B between the clamping surfaces 42 and 64.

The ski exercise machine 10 is now ready for operation in the synchronous exercise mode. In this mode, the foot trolleys 16A and 16B reciprocate in opposite directions, namely as the foot trolley 16A moves forward, the foot trolley 16B moves backward and vice versa. Specifically, as the foot trolley 16A moves forward, the upper course 50A of the drive belt 32A moves forward, while the lower course 52A of the drive belt 32A moves backward. The quick change mechanism 12 operatively connects or couples the movements of the foot trolley 16A or upper course 50A of the drive belt 32A to the movements of the lower course 52B of the drive belt 32B. Thus, the lower course 52B of the drive belt 32B also moves forward. This requires the upper course 50B of the drive belt 32B and the foot trolley 16B to move backward. Accordingly, it can be appreciated that the quick change mechanism 12 does not have to be connected to a foot trolley 16A or 16B and may be independent of the foot trolleys 16A and 16B as long as the appropriate connection between the drive belts 32A and 32B is formed. If the user wishes to change the ski exercise machine 10 from the synchronous mode to the asynchronous mode, the user again takes a suitable tool and rotates the set screw 46. This time, the set screw 46 is rotated in a direction opposite to the direction discussed earlier.

As the set screw 46 is rotated, the lock nut 62 is withdrawn from the contact surface 60. The movable member 40 is constructed such that gravity biases it towards the drive belt releasing position as the lock nut 62 and the adjacent end of the set screw 46 are withdrawn from the contact surface 60. The lock nut 62 prevents the set screw 46 from being removed from the aperture 44 in the fixed member 38. In some embodiments, the lock nut 62 may be welded to or formed integrally with the movable member 40. The set screw 46 is rotated to allow the lock nut 62 to withdraw sufficiently from the contact surface 60 so that there is sufficient clearance between the clamping surfaces 42 and 64 to allow the lower course 52B of the drive belt 32B to move freely between the clamping surfaces 42 and 64.

As can be appreciated, the ski exercise machine 10 can be changed between the synchronous exercise mode and the asynchronous exercise mode by appropriately turning the set screw 46. This quick change mechanism 12 is a substantial improvement over the exercise apparatuses discussed above. The quick change mechanism 12 may be attached to a movable element, such as a foot trolley 16A or 16B, or may be independent of the movable elements. The quick change mechanism 12 is simpler and less expensive than those prior art apparatuses, and may require less time to change the exercising modes of the piece of exercise equipment. A piece of exercise equipment having a quick change mechanism 12, constructed according to the teachings of the present invention, may be able to provide a user with a more effective workout.

While embodiments of the present invention are shown and described, it is envisioned that those skilled in the art may devise various modifications of the present invention without departing from the spirit and scope of the appended claims.

We claim:

1. A synchronous/asynchronous exercise machine changeable between a synchronous exercise mode and an asynchronous exercise mode, the synchronous/asynchronous exercise machine comprising:

a) a first movable element for accepting force;

b) a second movable element for accepting force;

c) a first drive belt operatively connected to the first movable element such that the first drive belt moves conjointly with the first movable element;

d) a second drive belt operatively connected to the second movable element such that the second drive belt moves conjointly with the second movable element; and e) a quick change mechanism operatively connected to the first movable element and releasably engagable with the second drive belt for changing the synchronous/asynchronous exercise machine between the synchronous exercise mode and the asynchronous exercise mode.

2. A synchronous/asynchronous exercise machine as defined in claim 1 wherein the quick change mechanism e) comprises i) a clamp element for releasably engaging the second drive belt; and the clamp element being movable between a first position whereat the clamp element clampingly engages the second drive belt, thereby placing the synchronous/asynchronous exercise machine in the synchronous exercise mode, and a second position whereat said second drive belt is released from the clamp element, thereby placing the exercise machine in the asynchronous exercise mode.

3. A synchronous/asynchronous exercise machine as defined in claim 1 wherein the quick change mechanism e) comprises i) a fixed member; and ii) a movable member operatively associated with the fixed member and movable between a first position whereat the quick change mechanism clampingly engages the second drive belt and a second position whereat said second drive belt is released from the quick change mechanism.

4. A synchronous/asynchronous exercise machine as defined in claim 3 wherein the quick change mechanism e) further comprises iii) a variable element operatively associated with the movable member for moving the movable member between the first position and the second position.

5. A synchronous/asynchronous exercise machine as defined in claim 4 wherein the variable element comprises a screw variably extending through the fixed member and engagable with the movable member for moving the movable member between the first position and the second position.

6. A synchronous/asynchronous exercise machine as defined in claim 3 wherein the movable member is pivotally attached to the fixed member.

7. A quick change mechanism for changing a synchronous/asynchronous exercise machine between a synchronous exercise mode and an asynchronous exercise mode, the synchronous/asynchronous exercise machine including a first movable element and a second movable element for accepting force, a first drive belt operatively connected to the first movable element such that the first drive belt moves conjointly with the first movable element, a second drive belt operatively connected to the second movable element such that the second drive belt and the second movable element move conjointly, the quick change mechanism comprising:

a) a clamp element operatively associated with the first drive belt and releasably engaging the second drive belt; and the clamp element being movable between a first position whereat the clamp element clampingly engages the second drive belt, thereby placing the synchronous/asynchronous exercise machine in the synchronous exercise mode, and a second position whereat said second drive belt is released from the clamp element, thereby placing the exercise machine in the asynchronous exercise mode.

8. A quick change mechanism as defined in claim 7 wherein the clamp element a) comprises i) a fixed member; and ii) a movable member operatively associated with the fixed member and movable between a first position whereat the second drive belt is clamped between the fixed member and the movable member, and a second position whereat said second drive belt is released from the clamp element.

9. A quick change mechanism as defined in claim 8 wherein the clamp element a) further comprises iii) a variable element operatively associated with the movable member for moving the movable member between the first position and the second position.

10. A quick change mechanism as defined in claim 9 wherein the variable element comprises a screw variably extending through the fixed member and engagable with the movable member for moving the movable member between the first position and the second position.

11. A quick change mechanism as defined in claim 8 wherein the movable member is pivotally attached to the fixed member.

12. The synchronous/asynchronous exercise machine as defined in claim 1 wherein the quick change mechanism releasably engages the second drive belt.

13. The synchronous/asynchronous exercise machine as defined in claim 1 wherein the quick change mechanism is disengaged from the second drive belt.

14. A ski exercise machine comprising:

a) a first movable element for accepting force;

b) a second movable element for accepting force;

c) a first drive belt having a first drive belt first course which moves in at least one direction and a first drive belt second course which moves in a direction opposite the first drive belt first course;

d) the first drive belt operatively connected to the first movable element such that the first drive belt moves conjointly with the first movable element;

e ) a second drive belt having a second drive belt first course which moves in at least one direction and a second drive belt second course which moves in a direction opposite the second drive belt first course;

f) the second drive belt operatively connected to the second movable element such that the second drive belt moves conjointly with the second movable element; and g) the first drive belt first course operatively connected by a clamp element to the second drive belt second course for creating synchronous movement of the first and second movable elements.

15. The ski exercise machine as defined in claim 14 wherein the clamp element comprises:

i) a fixed member; and ii) at least one movable member operatively associated with the fixed member and clampingly engaging at least the first or second drive belt.

16. The ski exercise machine as defined in claim 14 wherein the clamp element releasably clampingly engages at least the first or second drive belt.

* * * * *

UNITED STATES PATENT AND TRADEMARK OFFICE

CERTIFICATE OF CORRECTION

PATENT NO. : 5,499,957

DATED : March 19, 1996

INVENTOR(S) : Jeffrey D. Metcalf et al.

It is certified that error appears in the above-indentified patent and that said Letters Patent is hereby corrected as shown below:

On the Title Page Item [56]

In column 1, line 13 under "References Cited U.S. PATENT DOCUMENTS", delete "3,213,852 10/1965 Zent" and substitute --2,213,852 10/1965 Zent--.

On the Title Page (page 2)

In column 2, line 3 under "References Cited U.S. PATENT DOCUMENTS", after "Rodgers" insert--, Jr.--.

Signed and Sealed this

Twenty-second Day of July, 1997

Bruce Lehman

*Attest:*

BRUCE LEHMAN

*Attesting Officer*

*Commissioner of Patents and Trademarks*